United States Patent [19]

Mura

[11] 4,216,756

[45] Aug. 12, 1980

[54] VOLTAGE REGULATED MAGNETO POWERED CAPACITIVE DISCHARGE IGNITION SYSTEM

[75] Inventor: Richard J. Mura, Kenosha, Wis.

[73] Assignee: Outboard Marine Corporation, Waukegan, Ill.

[21] Appl. No.: 924,916

[22] Filed: Jul. 17, 1978

[51] Int. Cl.[2] ..... F02P 1/00

[52] U.S. Cl. ..... 123/597; 123/599

[58] Field of Search ..... 123/148 E, 148 CA, 148 CB, 123/148 CC, 148 CD, 149 R, 149 C, 149 D; 315/218, 209 CD, 209 SC; 323/22 R, 22 V, 22 SC, 22 T, 22 Z; 307/252 B

[56] References Cited

U.S. PATENT DOCUMENTS

| | | | |
|---|---|---|---|
| 3,636,936 | 1/1972 | Schuette et al. | 123/148 CB |
| 3,729,647 | 4/1973 | Mainprize | 123/148 CB |
| 3,781,163 | 12/1973 | Owens | 315/209 CD |
| 3,828,750 | 8/1974 | Schuette et al. | 123/148 CB |
| 3,842,816 | 10/1974 | Vargas | 123/148 CB |
| 3,885,170 | 5/1975 | Kuzyk | 307/252 B |
| 3,933,139 | 1/1976 | Boeghly | 315/209 CD |
| 3,974,816 | 8/1976 | Henderson et al. | 123/149 R |
| 4,038,584 | 7/1977 | Tarchalsk et al. | 307/252 B |
| 4,052,624 | 10/1977 | Hamstra | 307/252 B |
| 4,119,905 | 10/1978 | Head | 307/252 B |

*Primary Examiner*—Charles J. Myhre
*Assistant Examiner*—Raymond A. Nelli
*Attorney, Agent, or Firm*—Michael, Best & Friedrich

[57] ABSTRACT

Disclosed herein is a voltage regulated magneto powered capacitive discharge ignition system including a charge capacitor having opposite plates, a magneto including a charge coil having opposite end terminals, and a circuit including a full-wave bridge rectifier having input terminals respectively connected to the end terminals of the charge coil, and having output terminals respectively connected to the plates of the charge capacitor for insuring unidirectional current flow from the charge coil to the charge capacitor. The system also includes a voltage regulator including a triac having a gate, and having first and second anodes respectively connected to the end terminals of the charge coil, and also including a varistor having one terminal connected to one of the end terminals of the charge coil, and having another terminal connected to the triac gate. The varistor is rendered conductive and applies a trigger current pulse to the triac gate in response to voltage developed on the charge capacitor exceeding a predetermined value, whereby the triac is rendered conductive so that the charge coil is shunted by the triac and further charging of the charge capacitor is prevented.

5 Claims, 3 Drawing Figures

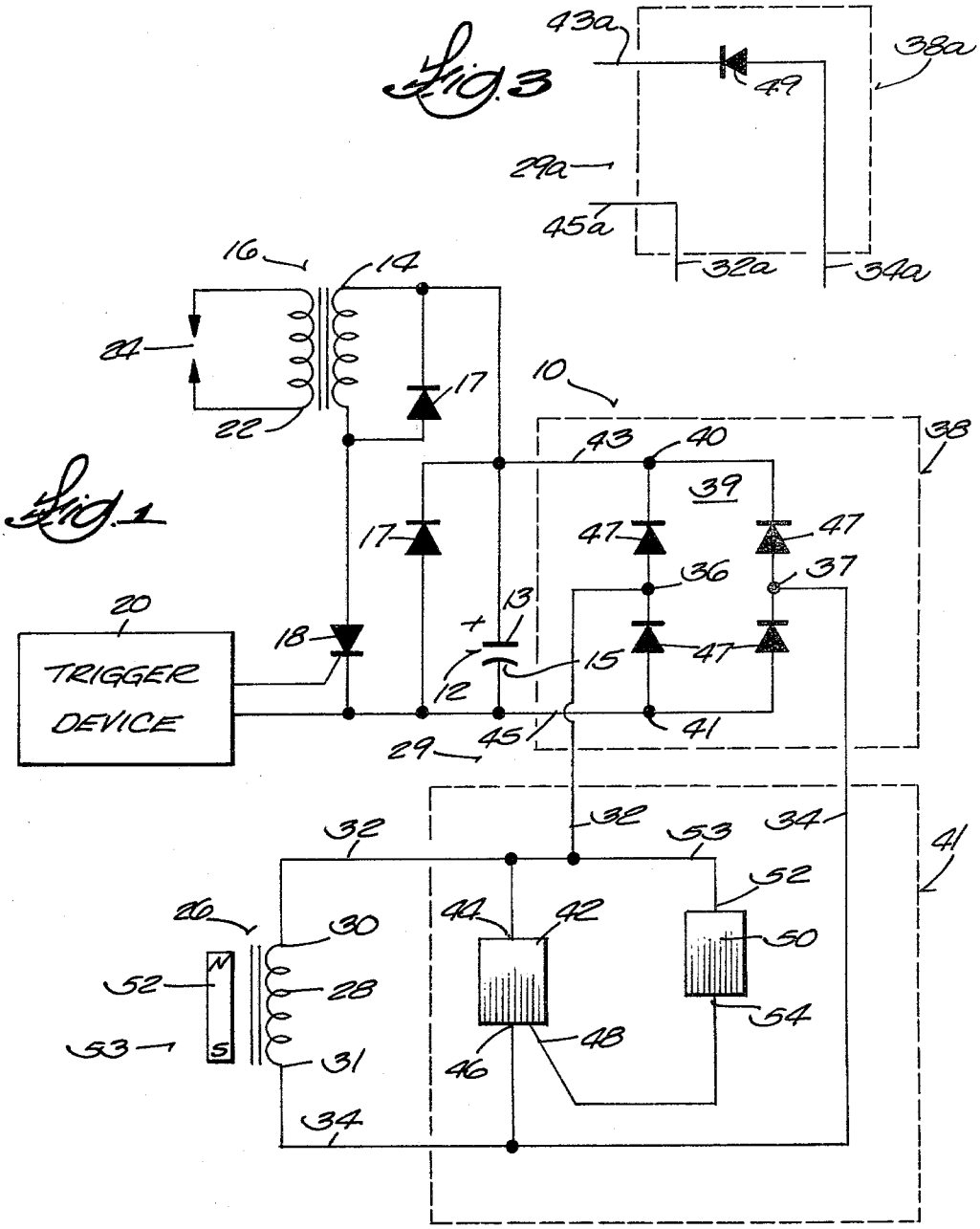
Fig. 1
Fig. 3
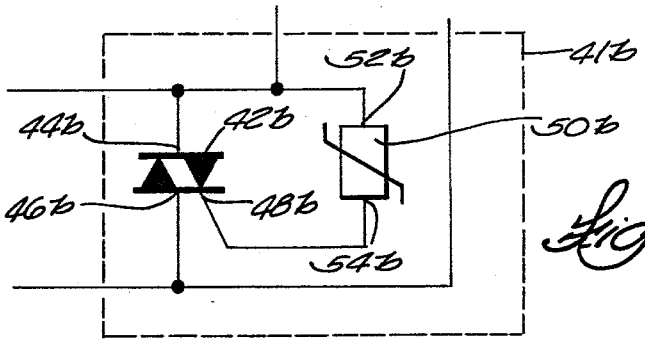
Fig. 2

VOLTAGE REGULATED MAGNETO POWERED CAPACITIVE DISCHARGE IGNITION SYSTEM

BACKGROUND OF THE INVENTION

The invention relates generally to magneto powered capacitive discharge ignition systems for internal combustion engines, and more particularly, to such ignition systems including voltage regulator circuits for regulating the voltage developed on a charge capacitor. Attention is directed to ignition systems disclosed in the following U.S. Pat. Nos.: Cavil 4,074,669 issued Feb. 21, 1978; Farr 3,490,426 issued Jan. 20, 1970; London 3,240,198 issued Mar. 15, 1966; Beuk 3,669,086 issued June 13, 1972.

Attention is also directed to Burke, U.S. Pat. No. 4,001,537 issued Jan. 4, 1977, Tolworthy, U.S. Pat. No. 3,714,546, issued Jan. 30, 1973 and to an advertisement including a circuit description of the Allison "OPTO XR-700" ignition system manufactured by Allison Automotive Co. located at 1267 East Edna Plaza, Covina, California. The Burke and Tolworthy patents and the Allison circuit description relate to semiconductor devices utilized in power or voltage regulator circuits.

Typical prior voltage regulator circuits utilized in magneto powered capacitive discharge ignition systems have employed SCR's or transistors triggered by zener diodes, or employed one or more series connected zener diodes, connected directly in parallel with the charge capacitor. Ideally, these regulator circuits prevent overcharging of the charge capacitor by limiting the magnitude of the voltage at the positive terminal of the charge capacitor to the zener diode breakdown voltage. The components of such voltage regulator circuits, however, are subject to high power dissipation and failure due to component tolerance and excessive voltage on the charge capacitor, or due to high magnitude voltage and current surges occurring during discharge of the charge capacitor through the primary winding of the ignition coil.

Another such typical prior voltage regulator circuit is disclosed in Farr, U.S. Pat. No. 3,490,426, wherein a zener diode is connected in parallel across the magneto charge coil upstream of a blocking diode. The zener diode in this arrangement limits the positive voltage output of the magneto charge coil to the zener diode breakdown voltage, but shunts the negative output of the charge coil, thereby undesirably reducing the speed at which charge capacitor charges, and consequently, the magnitude of the voltage developed thereon. Further the zener diode in the Farr arrangement is subject to excessive magneto charge coil voltage, due to component tolerance, or due to an open circuit fault in the ignition triggering SCR or the primary winding ignition coil circuits. As a result of such excessive voltage, the zener diode in Farr is subject to excessive power dissipation and consequent failure.

As noted above, typical prior art voltage regulator circuits utilized in magneto powered capacitive discharge ignition systems have been subject to zener diode and other voltage regulator component failures, and hence, have proven unreliable. The failure of such prior art voltage regulator circuits has been particularly serious and troublesome because it results in the failure of the ignition system, and more importantly, because it results in the failure of the internal combustion engine and vehicle which the ignition system controls. Such voltage regulator failure requires an annoying and costly replacement or repair of the voltage regulator circuit before the ignition system and hence, the internal combustion engine and vehicle, can again be made operative.

SUMMARY OF THE INVENTION

The invention disclosed herein provides a voltage regulated magneto powered capacitive discharge ignition system which substantially eliminates the problems and failures of the above noted prior art capacitive discharge ignition systems.

More particularly, the invention provides a voltage regulated magneto powered capacitive discharge ignition system including a charge capacitor having opposite plates, a magneto including a charge coil having opposite end terminals, and circuit means for respectively connecting the opposite plates of the charge capacitor to the end terminals of the charge coil and including rectifier means for insuring unidirectional current flow from the charge coil to the charge capacitor. The ignition system also includes voltage regulator means including three-terminal, bidirectional semiconductor switching means having first, second, and third terminals, the first and second terminals being respectively connected to the end terminals of the charge coil, the switching means being rendered conductive between the first and second terminals in response to a current trigger pulse applied to the third terminal and thereby shunting the charge coil. The voltage regulator means also includes two-terminal, bidirectional semiconductor trigger means having one terminal connected to the third terminal of the switching means and having another terminal connected to one of the end terminals of the charge coil, the trigger means being rendered conductive and applying a current trigger pulse to the third terminal of the switching means in response to voltage developed on the charge capacitor exceeding a predetermined value, whereby the switching means is rendered conductive so that the charge coil is shunted and further charging of the charge capacitor is prevented.

In accordance with an embodiment of the invention, the three-terminal, bidirectional switching means comprises a triac including first and second anodes which respectively comprise the first and second terminals of the switching means, and including a gate which comprises the third-terminal of the switching means. The two-terminal, bidirectional triggering means preferably comprises a varistor.

Also in accordance with an embodiment of the invention, the rectifier means comprises a full-wave bridge having input terminals respectively connected to the end terminals of the charge coil, and output terminals respectively connected to the plates of the charge capacitor. The first and second terminals of the three-terminal switching means are respectively connected to the bridge input terminals so that the switching means and the trigger means are isolated from current surges which result during discharge of the charge capacitor.

Also in accordance with an embodiment of the invention, there is provided a voltage regulated magneto powered capacitive discharge ignition system including a charge capacitor having opposite plates, a magneto including a charge coil having opposite end terminals, circuit means including a full-wave bridge rectifier having input terminals respectively connected to the end terminals of the charge coil, and having output terminals respectively connected to the plates of the charge capacitor for insuring unidirectional current flow from the charge coil to the charge capacitor. The system also includes voltage regulator means including a triac having a gate, and having first and second anodes respectively connected to the end terminals of the charge coil. The voltage regulator means also includes a varistor having one terminal connected to one of the end terminals of the charge coil, and having another terminal connected to the triac gate, the varistor being rendered conductive and applying a trigger current pulse to the triac gate in response to voltage developed on the charge capacitor exceeding a predetermined value, whereby the triac is rendered conductive so that the charge coil is shunted by the triac and further charging of the charge capacitor is prevented.

One of the principal features of the invention is to provide a voltage regulated magneto powered capacitive discharge ignition system including voltage regulator means which reliably prevents overcharging of the charge capacitor.

Another of the principal features of the invention is to provide such an ignition system wherein the voltage regulator means is protected from excess voltages and currents due to component tolerance or open circuit faults in the ignition triggering SCR or primary winding ignition coil circuits.

Another of the principal features of the invention is the provision of such an ignition system having circuit means including a full-wave bridge rectifier connected in circuit so that the voltage regulator means is isolated from the high magnitude voltage and current surges which occur during discharge of the the charge capacitor.

Another of the principal features of the invention is the provision of such an ignition system wherein the voltage regulator means includes a triac and a varistor connected in circuit to substantially eliminate regulator failure resulting from excessive power dissipation.

Other features and advantages of the embodiments of the invention will become known by reference to the following drawing, general description, and claims.

DRAWINGS

FIG. 1 is a schematic diagram of a voltage regulated magneto powered capacitive discharge ignition system embodying various features of the invention;

FIG. 2 is a schematic diagram illustrating specific components which can be utilized in the voltage regulator means of the ignition system shown in FIG. 1; and FIG. 3 is a schematic diagram illustrating a different component arrangement which can be utilized in the rectifier means of the ignition system shown in FIG. 1.

Before explaining the embodiments of the invention in detail, it is to be understood that the invention is not limited in its application to the details of construction and arrangements of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a voltage regulated magneto powered capacitive discharge ignition system 10, which includes a charge capacitor 12 connected in circuit with a primary winding 14 of an ignition coil 16 and a SCR 18 coupled to a suitable triggering device 20 which periodically renders the SCR conductive so that the charge capacitor 12 discharges through the primary winding 14, inducing a voltage in the secondary winding 22 to fire a spark plug 24. Free wheeling diodes 17, are conventionally coupled across the charge capacitor 12 and primary winding 14 to shunt negative voltage surges. In order to deliver a charging current to the charge capacitor 12, the system 10 includes a magneto 26 having a charge coil 28 with end terminals 30 and 31.

More particularly, the system 10 also includes circuit means, generally designated 29, including leads 32 and 34 for respectively connecting the opposite plates 13 and 15 of the charge capacitor 12 to the end terminals 30 and 31 of the charge coil 28. The circuit means also includes rectifier means, generally designated 38, for insuring unidirectional current flow from the charge coil 28 to the charge capacitor 12 so that a voltage is impressed across the capacitor such that plate 13 is positive, and plate 15 is negative. The voltage of the charge coil follows and is substantially the same as the voltage developed on the charge capacitor as a result of the charging current. As shown in FIG. 2, the rectifier means 38 preferably comprises a full-wave bridge 39 having four conventionally connected diodes 47. The full-wave bridge 39 includes a pair of input terminals 36 and 37 respectively connected to the charging coil end terminals 30 and 31 through leads 32 and 34, and a pair of output terminals 40 and 41 respectively connected to the capacitor plates 13 and 15 by leads 43 and 45, also included in the circuit means 29.

The ignition system 10 also includes voltage regulator means, generally designated 41, which is connected in circuit between the magneto charge coil 28 and the rectifier means or full-wave bridge input terminals 36 and 37. More particularly, the voltage regulator means 41 includes a three-terminal, bidirectional semiconductor switching means 42, having first and second terminals, 44 and 46, respectively connected to the end terminals 30 and 31 of the charge coil 28 by leads 32 and 34, and having a third terminal 48 which is connected as described below. The switching means 42 is rendered conductive between the first and second terminals 44 and 46 in response to a current trigger pulse applied to the third terminal 48, and thereby short circuits or shunts charge coil 28.

The voltage regulator means 41 also includes a two-terminal, bidirectional semiconductor trigger means 50, having one terminal 54 connected to the third terminal 48 of the switching means 42, and having the other terminal 52 connected to one of the end terminals of the charge coil. Preferably the other terminal 52 is connected to end terminal 30 of the charge coil 28 by leads 53 and 32, as shown in FIG. 2. The triggering means 50 is rendered conductive and applies a current trigger pulse to the third terminal 48 of the switching means 42 in response to the voltage developed on the charge capacitor exceeding a predetermined value which is equal to the breakdown value or knee of the trigger means 50. Upon application of such a trigger pulse to the third terminal 48, the switching means 42 is rendered conductive between terminals 44 and 46 so that the charge coil 28 is shunted, and further charging of the charge capacitor 12 is prevented. Thus, the voltage regulator means 41 limits the charging of the charge capacitor 12 after the voltage on the charge capacitor exceeds the predetermined value or breakdown value of the trigger means 50, and thereby effects the desired voltage regulation.

In the preferred construction shown in FIG. 1, the voltage regulator means 41 is isolated and protected from discharge surge currents which result during discharge of the charge capacitor 12. More particularly, since the first and second terminals 44 and 46 of the switching means 42 are respectively connected to the full-wave bridge input terminals 36 and 37, no potential difference or voltage can be fed back through the input terminals 36 and 37 to the first and second terminals 44 and 46. This is because the bridge diodes 47 provide for unidirectional current flow and block any positive voltage being transmitted back to the voltage regulator means. Negative voltages which appear along lead 43 pass through both of the diodes 47 having their cathodes connected to lead 43, and hence both bridge input terminals 36 and 37 are at the same potential so no potential difference, or voltage, is impressed across leads 32 and 34, and hence, the voltage regulator means 41 connected thereto.

Although the ignition system 10 preferably includes a full-wave bridge connected as shown in FIG. 1 so that the voltage regulator means 41 is isolated from discharge surge currents, the regulator means 41 could be successfully utilized with different rectifier means where such isolation is not achieved. More particularly, as shown in FIG. 3, rectifier means labeled **38*a* could be substituted for the rectifier means 38 shown in FIG. 1. Correspondence with the rectifier means 38 shown in FIG. 1 is indicated by the subscript "a". Rectifier means 38*a* includes a single blocking diode or half-wave rectifier 49 which only allows positive voltages and current flowing from the magneto charge coil 28 to reach the charge capacitor 12**.

As shown in FIG. 3, the circuit means **29*a* connecting the diode 49 in circuit includes lead 34*a* connected to the anode of diode 49, lead 43*a* connected to the cathode of diode 49, and lead 23*a* connected directly to lead 45*a*. With this circuit arrangement, negative voltage surges appearing on line 43*a*, such as result from discharge of the charge capacitor, are conveyed through diode 49 to the voltage regulator means 41 by lead 34*a*. Such voltage surges will not cause failure of the voltage regulator means 41, however, because the voltage impressed across the regulator means is limited to the breakdown value of the trigger means 50**, as will be further explained in a more detailed description of operation below.

For purposes of providing a more detailed description of operation, reference will be made to the voltage regulator means **41*b* shown in FIG. 2, and which illustrates the preferred specific components utilized in the more generally illustrated voltage regulator means 41 shown in FIG. 1. More particularly, as shown in FIG. 2, the three-terminal bidirectional switching means preferably comprises a triac 42*b*. Correspondence with the regulator means 41 shown in FIG. 1 is indicated by the subscript "b". The triac 42*b* includes first and second anodes 44*b* and 46*b*, and a gate 48*b*, and is rendered conductive between the first and second anodes by a trigger current pulse, for example, in the range of 5 to 25 milliamperes at a voltage having a magnitude in a range of 0.7 volts or greater. Other bidirectional switching means having switching characteristics similar to a triac could be utilized, for example, two SCRs connected in inverse parallel and having a commonly connected gate. The bidirectional switching characteristic, and conduction achieved with a voltage magnitude at a relatively low value, e.g. 0.7 volts, are important features of the triac or other suitable switching means. These features result in the triac shunting the charge coil 28** for both polarities, thereby effectively limiting charging of the charge capacitor, and yet, because of the low value voltage, there is relatively little potentially damaging power dissipatation in the triac or other suitable switching means.

The bidirectional trigger means preferably comprises a metal oxide varistor **50*b*, having a voltage dependent nonlinear resistance or knee that drops so that the varistor is rendered substantially conductive when the voltage across the charge capacitor, and hence, across the varistor terminals 52*b* and 54*b*, (discounting the relatively small voltage drop across the diodes 47 of the full-wave bridge 39, and across the internal resistance between the triac anode 46*a* and gate 48*a*), exceeds a predetermined value or the breakdown value of the varistor, eg., 350–450 volts, whereby a current trigger pulse sufficient to trigger the triac is applied to the triac gate 48*a***. Other bidirectional trigger means having characteristics similar to a varistor could be utilized, for example, two zener diodes connected in series back to back. The breakdown value and the bidirectional switching characteristic are important features of the varistor or other suitable trigger means since the bidirectional breakdown value sets the magnitude of voltage, for either polarity, at which the triac is gated, and hence sets the voltage level at which the charge capacitor is regulated.

During operation of the ignition system 10, an alterating voltage is developed across the terminals 30 and 31 of the magneto charge coil 28 in response to rotation of magnets 52 of the magneto 53 (see FIG. 1). This voltage is full-wave rectified by the diode bridge 39 and the charging current is fed to the charge capacitor 12 so that the capacitor plate 13 has a positive polarity as shown. Since the charge capacitor provides the load for the magneto charge coil, the magnitude of the voltage across the charge coil follows and is substantially the same as the magnitude of the voltage developed across the charge capacitor. The maximum magnitude of the voltage developed on the charge capacitor 12 is, for example, within a range of 350 to 450 volts. The ignition SCR 18 is triggered into conduction by a conventional triggering device 20, such as a trigger coil (not specificly shown). When the ignition SCR 18 is triggered, current flows from plate 13 of the charge capacitor 12 through the ignition coil primary winding 14, through SCR 18 and back to the plate 15 of the capacitor, as a result of which the secondary winding 22 of the ignition coil 16 steps up the voltage to fire the spark plug 24.

The voltage regulator means 41 operates to limit the charging current and voltage developed on the charge capacitor 12 as follows. As the engine speed increases, the magnitude of the charging voltage on the charge capacitor increases, and may exceed device ratings due to component tolerances. The triggering means or varistor **52*a* conducts when the voltage of the charge capacitor increases above a predetermined value or the breakdown value of the varistor. The current flowing through the varistor at this predetermined voltage value triggers the triac to conduct between its anodes 44*b* and 46*b*, thus shunting the charge coil 28, and preventing any further charging current from reaching the charge capacitor. Because of triac and varistor component tolerences, the predetermined value of voltage on the capacitor varies, e.g., within a range of 350 to 450 volts. Such a variance has no determinal effect on the operation of the ignition system 10**.

When the triac 42b is triggered, the voltage across the charge coil 28 and the varistor 50 rapidly approaches zero, with the result that the varistor no longer conducts, but the triac remains switched on, even at voltages of relatively small magnitude, e.g., 0.7 volts. Consequently there is relatively little power dissipation in either the varistor or the triac. The triac turns off when the charge coil voltage passes through zero while changing polarity, but the triac is again triggered into conduction when the magnitude of the opposite polarity of voltage developed across the charge coil again reaches the predetermined value or breakdown value of the varistor. Thus, whenever the magnitude of voltage developed on the charge coil, which is normally substantially the same as that developed on the charge capacitor, exceeds the predetermined value or breakdown value of the varistor, the varistor triggers the triac into conduction, and the triac, in turn, shunts the charge coil to prevent overcharging of the capacitor.

If, for any reason, the charge capacitor is not charging and discharging in the normal manner, for example, as a result of open circuit faults in the ignition triggering SCR or primary winding ignition coil circuits, the charge capacitor voltage will be maintained and overcharging will be prevented by the voltage regulator means since the voltage developed by the magneto charge coil is limited to the predetermined or breakdown value of the varistor as previously discussed. For the same reason, any negative voltage surges which may be conveyed back through the rectifier means to the voltage regulator means will be limited so that it will not damage the components of the voltage regulator means. This is because the varistor conducts only long enough to trigger the triac, at which point the voltage across the triac, which acts as a shunt, rapidly approaches zero, thereby preventing overcharging of the charge capacitor. Consequently there is relatively little power dissipation in the voltage regulator circuit, and no damage to these or other components of the ignition system.

It is to be understood that the ignition system disclosed could be readily modified to be applicable to multi-cylinder magneto ignition systems having multiple ignition trigger circuits, and to ignition coils or distributed output systems using full-wave or half-wave rectification for charging the charge capacitor. Thus, it is to be understood that the invention is not confined to the particular construction and arrangement of parts herein illustrated and described, but embraces all such modified forms thereof, as come within the scope of the following claims.

What is claimed is:

1. A voltage regulated magneto powered capacitive discharge ignition system comprising a charge capacitor having opposite plates, a magneto including a charge coil having opposite end terminals, circuit means for respectively connecting said opposite plates of said charge capacitor to said end terminals of said charge coil and including rectifier means for insuring unidirectional current flow from said charge coil to said charge capacitor, said rectifier means comprising a full-wave bridge rectifier having input terminals respectively connected to said end terminals of said charge coil, and output terminals respectively connected to said plates of said charge capacitor, and voltage regulator means including three-terminal, bidirectional semiconductor switching means having first, second, and third terminals, said first and second terminals being respectively connected to said end terminals of said charge coil and to said input terminals of said full-wave bridge rectifier, said switching means being rendered conductive between said first and second terminals in response to a current trigger pulse applied to said third terminal and thereby shunting said charge coil, said voltage regulator means also including two-terminal, bidirectional semiconductor trigger means having one terminal connected to said third terminal of said switching means and having another terminal connected to one of said end terminals of said charge coil and one of said input terminals of said full-wave bridge rectifier, whereby said switching means and said two-terminal bidirectional trigger means are isolated by said full-wave bridge rectifier from current surges which result during discharge of said charge capacitor, said trigger means being rendered conductive and applying a current trigger pulse to said third terminal of said switching means in response to voltage developed on said charge capacitor exceeding a predetermined value, whereby said switching means is rendered conductive so that said charge coil is shunted and further charging of said charge capacitor is prevented.

2. A voltage regulated magneto powered capacitive discharge ignition system in accordance with claim 1 wherein said three-terminal, bidirectional switching means comprises a triac including first and second anodes which respectively comprise said first and second terminals of said switching means, and including a gate which comprises said third-terminal of said switching means.

3. A voltage regulated magneto powered capacitive discharge ignition system in accordance with claim 1 wherein said two-terminal, bidirectional triggering means comprises a varistor.

4. A voltage regulated magneto capacitive discharge ignition system in accordance with claim 1 wherein said three-terminal, bidirection switching means comprises a triac including first and second anodes which respectively comprise said first and second terminals of said switching means, and including a gate which comprises said third terminal of said switching means, and wherein said two-terminal, bidirectional triggering means comprises a varistor.

5. A voltage regulated magneto powered capacitive discharge ignition system comprising a charge capacitor having opposite plates, a magneto including a charge coil having opposite end terminals, circuit means including a full-wave bridge rectifier having input terminals respectively connected to said end terminals of said charge coil, and having output terminals respectively connected to said plates of said charge capacitor for insuring unidirectional current flow from said charge coil to said charge capacitor, and voltage regulator means including a triac having a gate, and having first and second anodes respectively connected to said end terminals of said charge coil and to said input terminals of said full-wave bridge rectifier, and also including a varistor having one terminal connected to one of said end terminals of said charge coil and one of said input terminals of said bridge rectifier, and having another terminal connected to said triac gate, said connection of said triac and said varistor to said full-wave bridge rectifier input terminals resulting in said triac and said varistor being isolated from current surges which result during discharge of said charge capacitor, said varistor being rendered conductive and applying a trigger current pulse to said triac gate in response to voltage developed on said charge capacitor exceeding a predetermined value, whereby said triac is rendered conductive so that said charge coil is shunted by said triac and further charging of said charge capacitor is prevented.

* * * * *